US007771591B2

(12) United States Patent
Lucas

(10) Patent No.: US 7,771,591 B2
(45) Date of Patent: Aug. 10, 2010

(54) FILTER SYSTEM FOR CATCH BASINS

(76) Inventor: Chassidy Lucas, 18517 71st Ave. Court East, Puyallup, WA (US) 98375-2355

( * ) Notice: Subject to any disclaimer, the term of this patent is extended or adjusted under 35 U.S.C. 154(b) by 6 days.

(21) Appl. No.: 11/977,226

(22) Filed: Oct. 23, 2007

(65) Prior Publication Data

US 2009/0101553 A1 Apr. 23, 2009

(51) Int. Cl.
*E03F 5/06* (2006.01)

(52) U.S. Cl. ..... 210/163; 210/337; 210/339; 210/455; 210/474; 210/489; 404/4

(58) Field of Classification Search ..... 210/163, 210/164, 170.03, 337, 339, 455, 461, 474, 210/489; 404/4, 5
See application file for complete search history.

(56) References Cited

U.S. PATENT DOCUMENTS 4,419,232 A * 12/1983 Arntyr et al. ..... 210/164
5,405,539 A * 4/1995 Schneider ..... 210/163
5,733,445 A * 3/1998 Fanelli ..... 210/164
6,086,758 A * 7/2000 Schilling et al. ..... 210/164
6,562,233 B1 * 5/2003 Schilling et al. ..... 210/164
6,872,029 B2 * 3/2005 Allard et al. ..... 210/164
7,112,274 B1 * 9/2006 Sanguinetti ..... 210/163
7,132,045 B1 * 11/2006 Trangsrud ..... 210/163
7,524,414 B1 * 4/2009 Barragan ..... 210/163
2008/0290042 A1 * 11/2008 Hanson et al. ..... 210/164

* cited by examiner

*Primary Examiner*—Christopher Upton
(74) *Attorney, Agent, or Firm*—Floyd E. Ivey

(57) ABSTRACT

A first filter basket (20) sits down into a catch basin (10) and has an upper flange (24) that rests on a shoulder (14) provided in the catch basin (10) for supporting a grate (16). The filter basket (20) has expanded metal side and bottom walls which are adapted to pass liquid and catch particulate material larger in size than the wall openings. A geo-textile liner (42) is optionally positioned inside of the filter basket (20). The liner (42) is supported on a lower rim flange (26). Posts (40) on the rim flange (26) extend upwardly through openings (66) in marginal portions of the liner (42). A smaller second filter basket (72) is optionally supported inside the larger first filter basket (20). An absorbent pillow (90) may be positioned between the bottoms of the two filter baskets (20, 72) to catch and absorb oils and greases that are in the liquid that enters the catch basin (10).

21 Claims, 9 Drawing Sheets

FILTER SYSTEM FOR CATCH BASINS

TECHNICAL FIELD

The present invention relates to catch basins used in drainage systems. More particularly, it relates to a filter system for removing debris and contaminants, including oil and grease from the drain water so that they will not enter the system of drainage pipes to which the catch basins are connected.

BACKGROUND OF THE INVENTION

It is common to collect drainage water by use of a system of catch basins which are buried in the ground and are connected to a network of drain pipe. A problem is that the drainage water often includes debris and contaminants, and sometimes oil and grease. It is not desirable for these contaminants to get into the drain water which is expect to eventually reenter the earth's rivers, etc. which include fish, etc. There is a need for an effective and economic system for removing the debris and contaminants from the drainage water. The main object of this invention is to fill this need by providing a filter system installable into the catch basins for catching the debris and contaminants and removing them from the drainage water. It is a further object of the present invention to provide such a filter system which is easy to install, remove and maintain.

BRIEF SUMMARY OF THE INVENTION

A typical catch basin has side and bottom walls, a top opening and a grate which extends over the top opening. The catch basin is buried and the grate is substantially flush with the surface surrounding the catch basin. Lower interior regions of the catch basins are connected to drainage pipes which form a drainage pipe network. The filter system of the present invention includes a filter basket having horizontal and vertical frame members and pervious side and bottom walls that are secured to the frame members. An outwardly directed upper flange is adapted to set down onto the grate supporting shoulder of the catch basin when the filter basket is inside the catch basin. An inwardly directed lower flange is spaced below the upper flange, and a vertical wall extends between the upper and lower flanges. The lower flange includes vertically upwardly extending posts spaced laterally from the vertical wall.

Another aspect of the invention is the provision of a filter member that is smaller than the filter basket. The filter member is positioned inside the filter basket and has side and bottom walls. The sidewalls include upper rim portions which include openings for receiving the posts on the lower flange of the filter basket. Preferably, the filter member is made from a fabric material that is adapted to absorb small particles.

In preferred form, one, some or all of the sidewalls of the filter member include a cutaway that extends from an upper edge of the sidewall downwardly into the sidewall. In preferred form, all four of the sidewalls of the filter member have these cutouts. In some embodiments, the upper rim portion of the filter member includes four side parts, one for each sidewall of the filter member. Two openings are provided in each side part of the rim portion. The lower flange of the filter basket includes a post for each said opening.

According to another aspect of the invention, a second filter basket is provided and is sized to sit down into the first filter basket. The second filter basket has side and bottom walls that are spaced inwardly and upwardly from the side and bottom walls of the first filter basket. The second filter basket has a flange at its upper end that includes openings into which the mounting posts are received when the second filter basket is in the first filter basket. When the second filter basket is inside the first filter basket, spaces exist horizontally between the sidewalls of the first and second filter baskets and vertically between the bottoms of the first and second filter baskets.

According to yet another aspect of the invention, an absorbent filter pillow is positioned inside the first filter basket between the bottom of the first filter basket and the bottom of the second filter basket. This absorbent filter pillow includes a pervious cover or casing and oil-absorbing filler material inside the cover or casing.

Preferably, the side and bottom walls of the filter baskets are constructed from expanded metal. In some embodiments, the filter basket has four quadrate sides and a quadrate bottom. In other embodiments, the filter basket has a cylindrical sidewall, a circular bottom wall, and a top flange in the form of a circular ring.

Other objects, advantages and features of the invention will become apparent from the description of the preferred embodiments set forth below, from the drawings, from the claims and from the principles that are embodied in the specific structures that are illustrated and described.

BRIEF DESCRIPTION OF THE SEVERAL VIEWS OF THE DRAWINGS

Like reference numerals refer to like parts throughout the several views of the drawing, and.

DETAILED DESCRIPTION OF THE ILLUSTRATED EMBODIMENT

Figure 1:
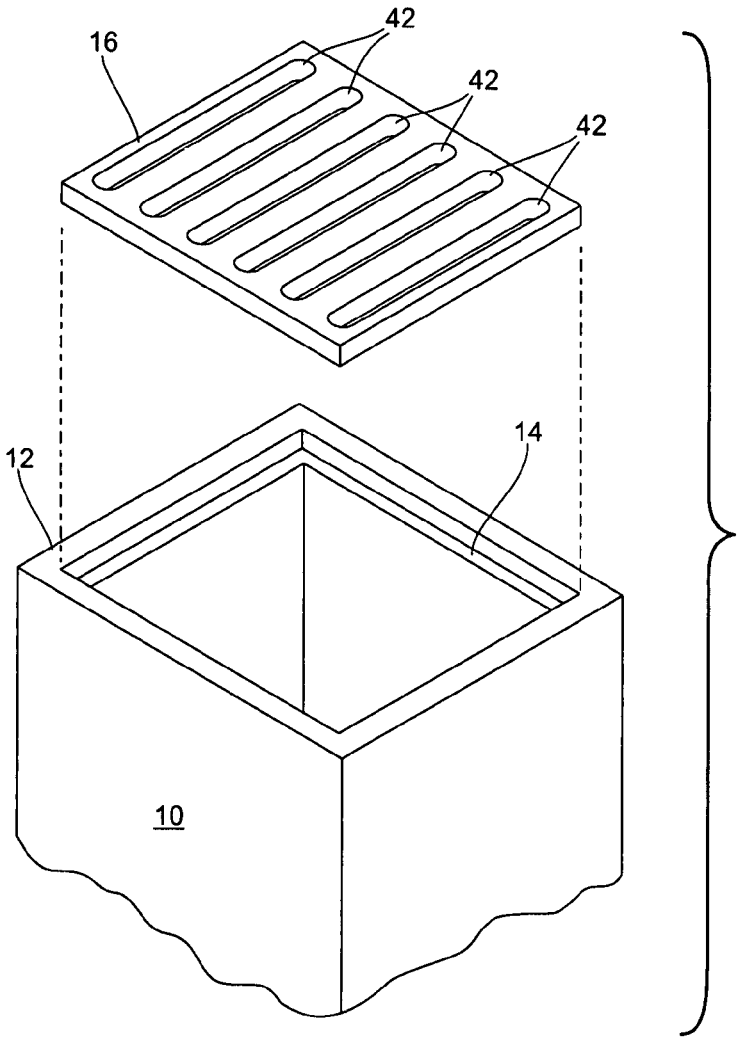
Fig. 1 (PRIOR ART)
FIG. 1 is a fragmentary pictorial view of a conventional catch basin, with a grate at its top shown spaced vertically above the grate's installed position.
Figure 2:
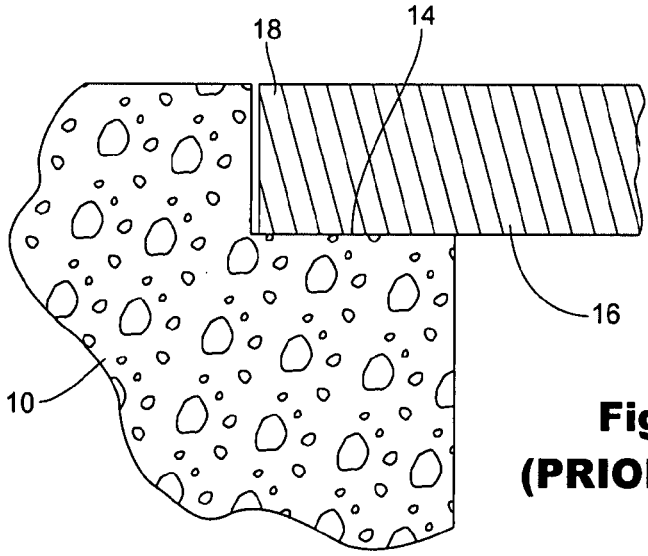
Fig. 2 (PRIOR ART)
FIG. 2 is a fragmentary sectional view showing an edge portion of the grate sitting down onto a shoulder formed in the main body of the catch basin, such view showing the shoulder supporting an edge portion of the grate.
Figure 3:
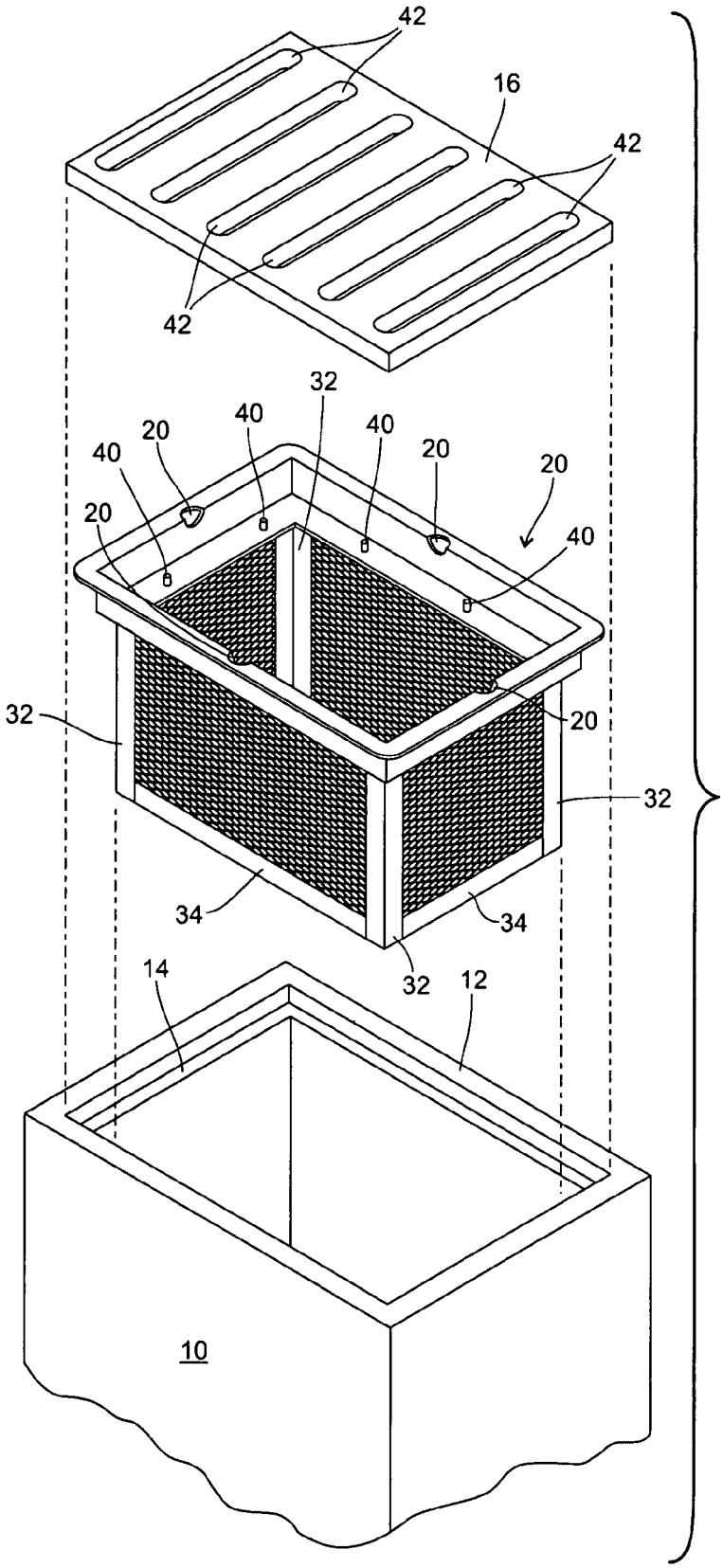
FIG. 3 is a view like FIG. 1, but showing a filter basket of the present invention positioned between the catch basin and the grate.

FIGS. 1 and 2 show a conventional catch basin 10 which is typically constructed from concrete and includes closed side and bottom walls and an open top. The top is surrounded by a rim 12 and a shoulder 14 spaced below the rim 12. Shoulder 14 normally receives and supports a grate 16 which is typically constructed from cast iron. FIG. 2 shows an edge portion 18 of the grate 16 resting on the shoulder 14. FIG. 3 shows a filter basket 20 that is adapted to fit down inside the catch basin 10. Filter basket 20 has an upper rim portion 22 comprising an upper flange 24, a lower flange 26 and a vertical wall 28. Actually, upper rim structure 22 has four flanges 24, four flanges 26, and four walls 28. Each flange 24 projects laterally outwardly from its wall 28 and each flange 26 projects laterally inwardly from its wall 28. Flanges 24 and 26 are parallel to each other and perpendicular to the walls 28, as clearly shown by FIG. 4.

Figure 4:
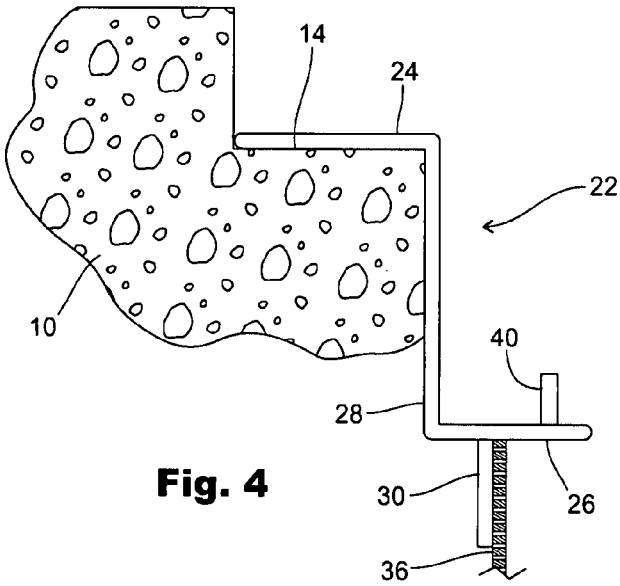
FIG. 4 is a view like FIG. 2, but showing an edge portion of the filter basket being supported on the shoulder of the grate.
Figure 8:
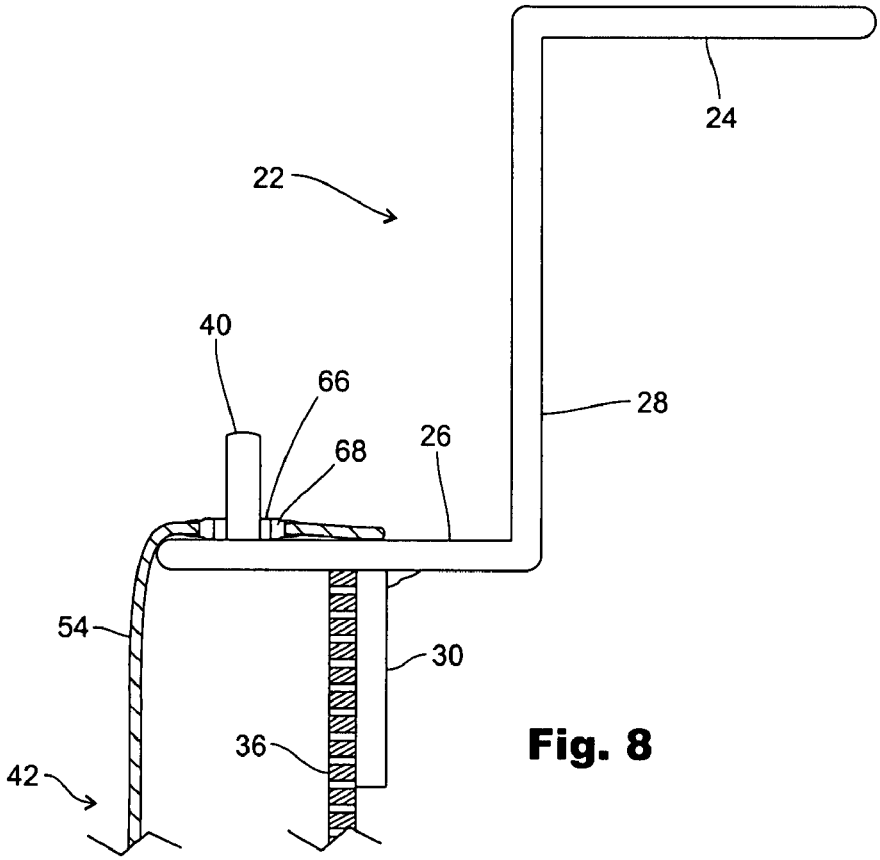
FIG. 8 is a fragmentary sectional view taken where a mounting ring on a mounting flange portion of the liner is on a mounting pin carried by a flange that projects laterally inwardly from a rim portion of the filter basket.

In addition to the upper rim structure 22, the basket 20 has horizontal and vertical frame members that are best shown by FIGS. 3, 4 and 8. The frame members include an upper horizontal frame member 30 on each side, vertical frame members 32 at each corner and horizontal frame members 34 extending between the bottom ends of the frame members 32. As shown by FIGS. 4 and 8, the upper horizontal frame members 30 extend vertically and are parallel to walls 28 and are perpendicular to flanges 24, 26. Frame members 32, 34 are preferably lengths of angle iron. The four sides and bottom walls of the basket 20 are preferably constructed from sheets of expanded metal or some other suitable pervious material. These walls 36 are welded to the frame members 30, 32, 34.

The basket 20 is adapted to fit inside the catch basin 10 with its upper flanges 24 resting on the shoulder 14, as shown by FIG. 4. Once the filter basket is inside the catch basin 10, the grate 16 can be installed so that it will sit down onto the flanges 24. The presence of the flanges 24 will raise the grate 16 slightly from the position it occupies on the shoulder 14 when the basket 20 is not inside the catch basin 10.

As shown by FIGS. 3, 4, 8, 10 and 11, the flanges 28 are provided with vertical posts 40. Posts 40 are spaced apart on the lower rim flange 26. By way of typical example, there may be two posts 40 on each rim flange 26. The posts 40 extend vertically and are perpendicular to the flanges 26. The purpose of the posts 40 is hereinafter described.

When the filter basket 20 is inside the catch basin 10, everything that enters the catch basin 10 through the openings 42 in the grate 16 must first enter the filter basket 20 before going any further in the catch basin 10. As can be easily appreciated, solid materials that are small enough to pass through the grate openings 42 but too large to pass through the openings in the side and bottom walls of the basket 20 are collected in the basket. The openings in the side and bottoms walls of the filter basket 20 are small enough that all but the smallest particulate material is captured in the filter basket 20.

Figure 5:
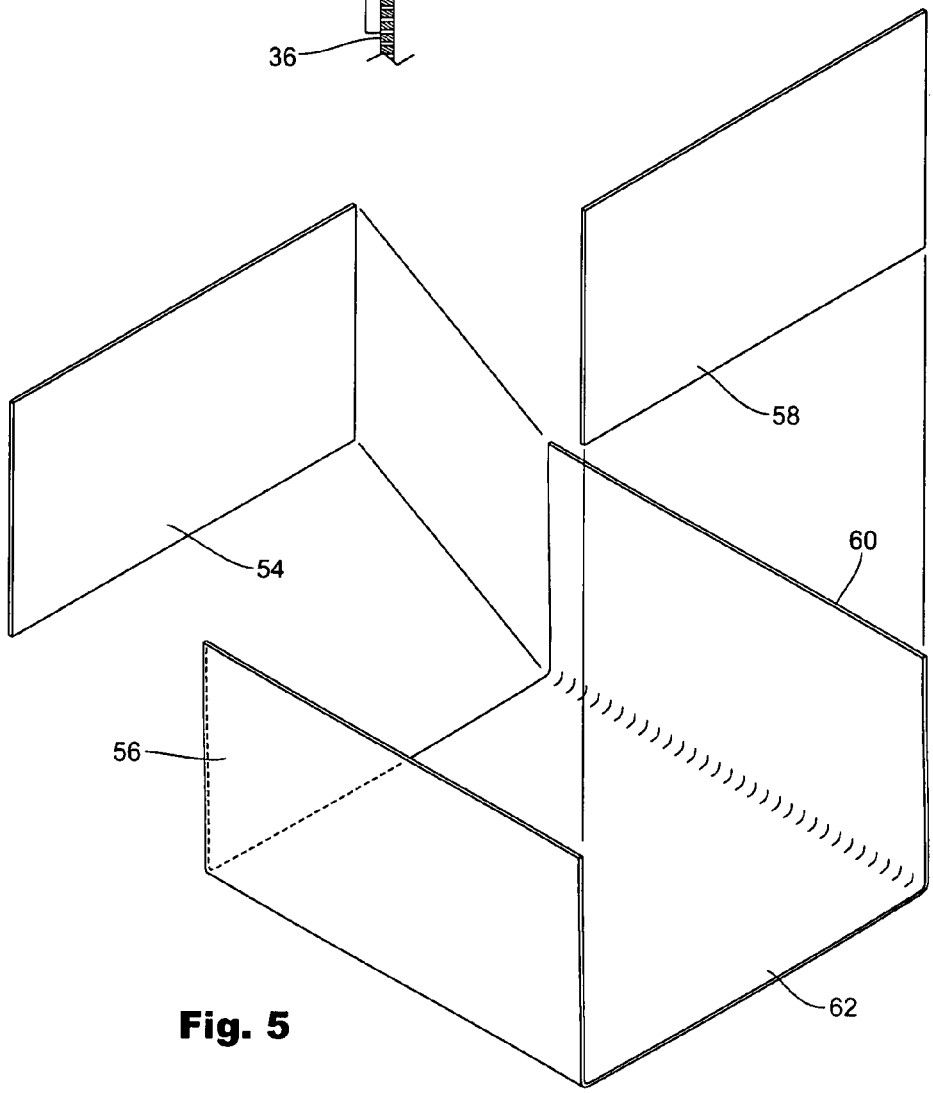
FIG. 5 is an exploded pictorial view of a three-piece liner in an unassembled condition.
Figure 6:
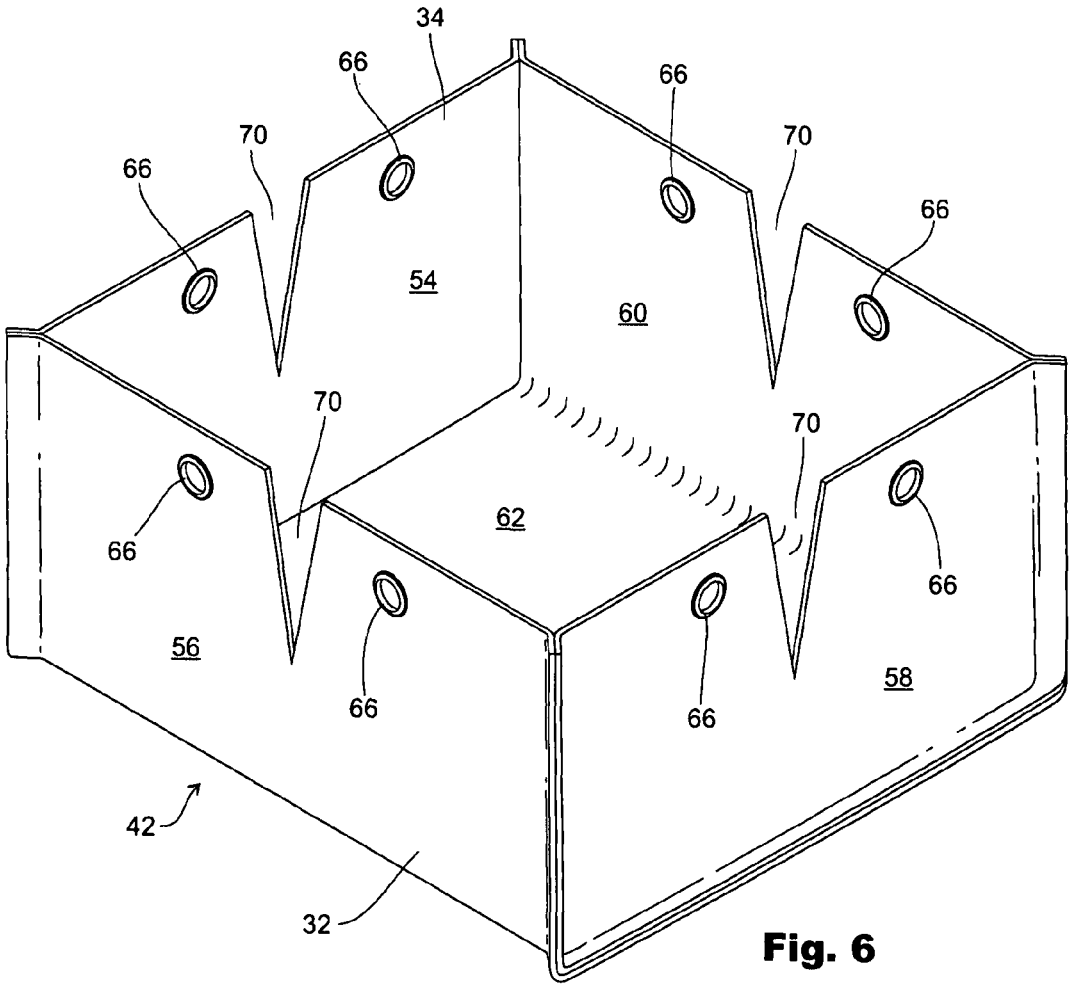
FIG. 6 is a view like FIG. 5, but showing the parts of the liner connected and the liner being adapted to fit into the filter basket.
Figure 7:
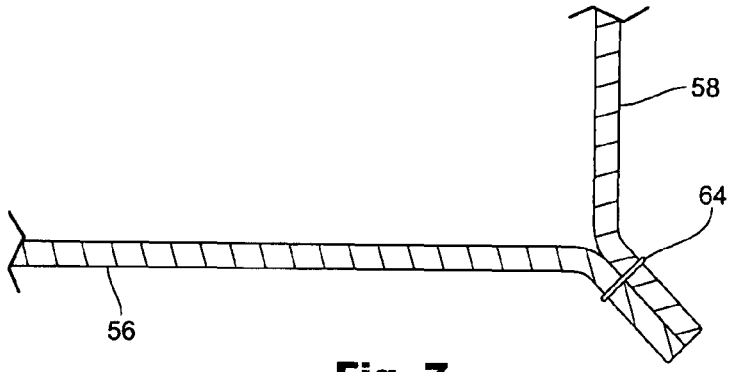
FIG. 7 is a view showing a corner region of the liner shown by FIG. 6, such view showing a way of connecting the sidewalls of the liner.
Figure 11:
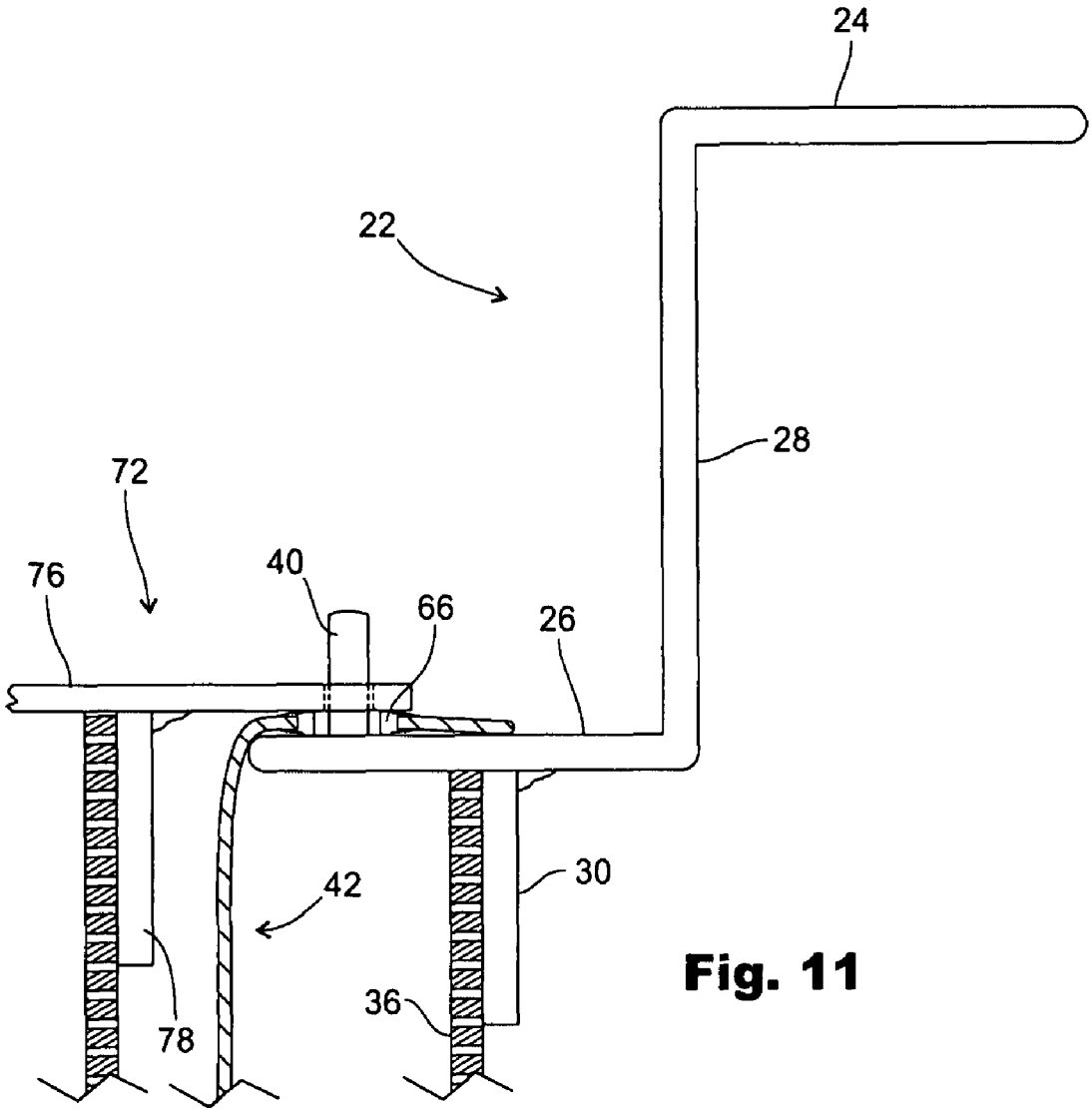
FIG. 11 is a view like FIG. 8, but showing the smaller filter basket positioned inside the larger filter basket with its supporting flange resting on the supporting flange of the larger filter basket.
Figure 12:
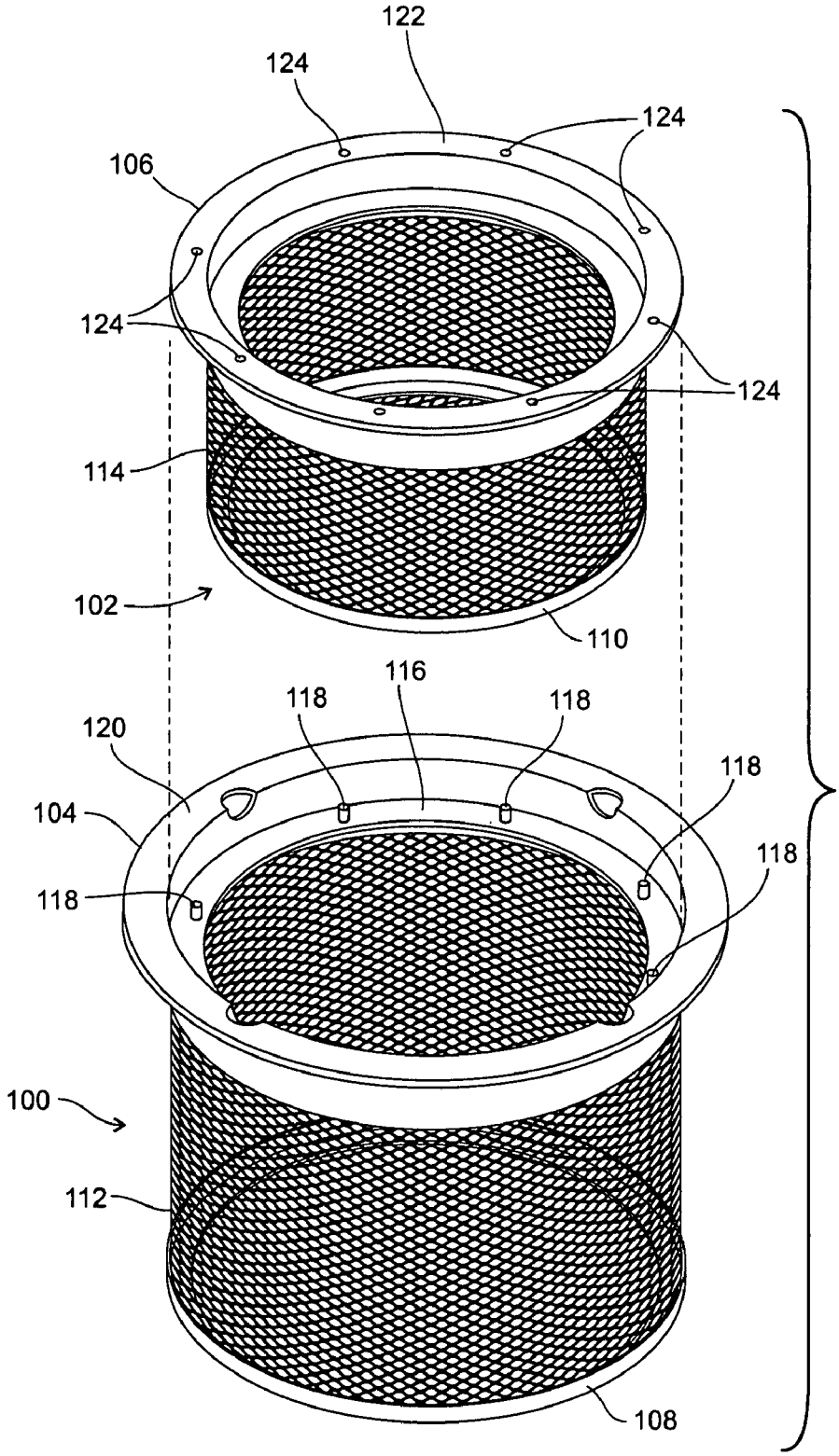
FIG. 12 is a view like FIG. 10, but showing filter baskets having a cylindrical shape.
Figure 14:
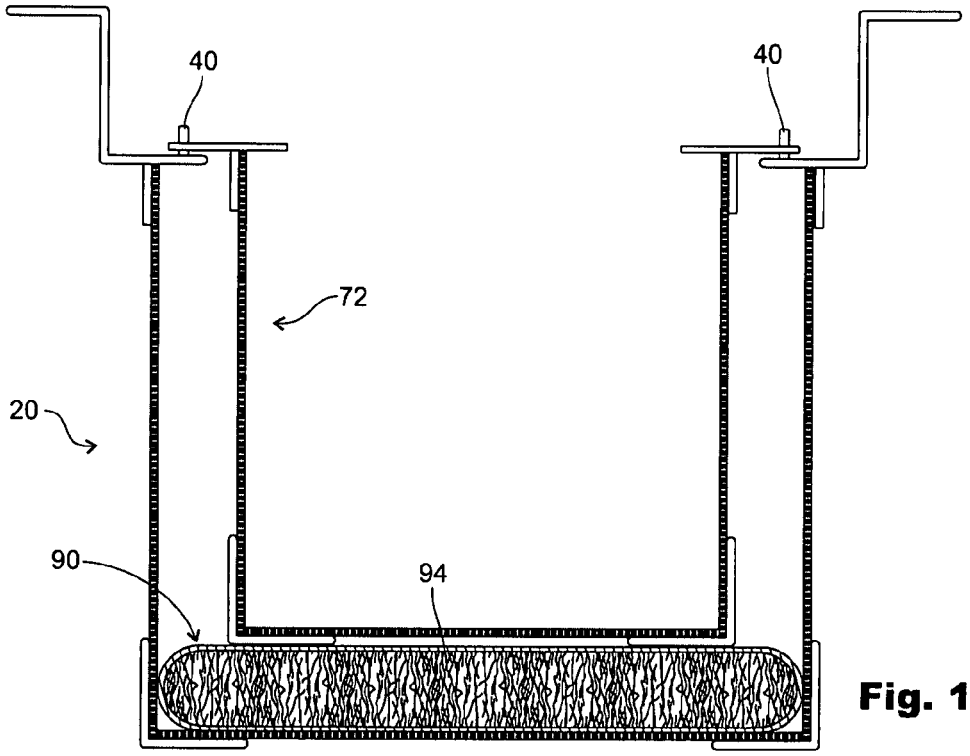
FIG. 14 is a vertical sectional view taken through both baskets and the oil absorbent filter pillow.

FIGS. 8, 11 and 14 illustrate a nesting filter device comprising at least a larger filter basket (22). Seen in FIGS. 8, 11 and 14 are successive additional filter devices added in addition to the at least a larger filter basket (22). The filter basket 20 may be provided with a geo-textile liner for increasing the filtration effectiveness of the system. Referring to FIGS. 5-7, the liner 42 may be constructed to have four sidewalls 54, 56, 58, 60 and a bottom wall 62. As shown by FIG. 5, the liner 42 may be conveniently constructed from three pieces of the liner material. Two pieces form the sidewalls 54, 58. A third larger piece forms the sidewalls 56, 60 and the bottom 62. As shown by FIG. 5, a piece of the material is cut to the proper size to form sidewalls 56, 60 and bottom 62. The sidewall portions 56, 60 of the material are bent upwardly relative to the rest of the material which forms the bottom 62. Members 54, 58 are suitable sized to close the ends of the U-shaped structure 56, 60, 62. As shown by FIG. 7, at the corners where they meet, the sidewall panels 54, 56, 58, 60 may be brought together and connected by stitching 64 which extends through border portions of the panels 54, 56, 58, 60 at the four corners. A suitable fabric for use in making the liner is a membrane liner that was developed for hazardous waste containment. This material is used in roadways, parking lots, construction compounds, industrial storage areas, embankments, dykes, railways, and ridge abutments, and also as a liner for landfills. PermeaTex is a trademark for a particular geotextile product that is marketed by Northwest Linings & Geotextile Products, Inc., having a business address of 21000 77th Avenue S., Kent, Wash. 98032. There are similar linings made by other manufacturers. For example, Geotextiles TNS Advance Technologies makes woven and non-woven geotextiles. Geotextiles TNS Advance Technologies has a place of business at 681 De Young Rd., Greer, S.C. 29651.

Figure 9:
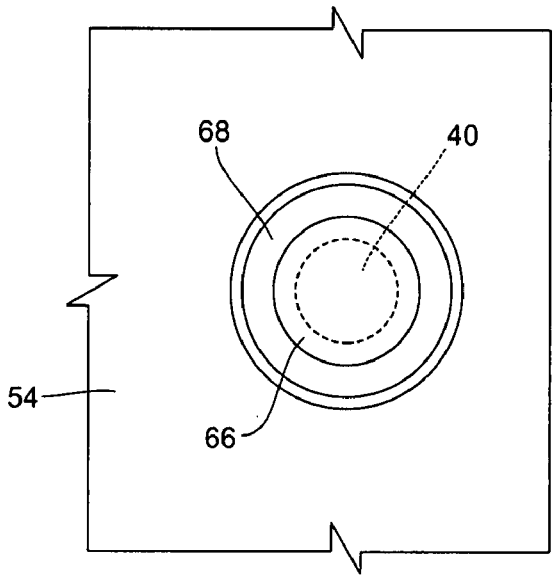
FIG. 9 is a fragmentary plan view of the liner flange showing the mounting pin and mounting ring.

As shown by FIG. 6, the upper margins of the sidewalls 54, 56, 58, 60 are provided with openings 66 which are sized and positioned to receive the posts 40 on the lower rim flange 26 of basket 20. Preferably, the openings 66 are reinforced by metal rings or grommets 68 or some other suitable reinforcing structure. FIG. 9 shows that with the grommet 68 attached to the fabric members 54, 56, 58, 60, around the openings in the fabric, the center openings in the grommets 68 become the pin-receiving openings 66.

Referring to FIG. 6, the upper portions of the liner sidewalls 54, 56, 58, 60 may be cut away at 70, between the openings 66. This provides some adjustability for the upper corner portions of the liner 42, facilitating the installation of the liner 42 inside the basket 20. The cutouts 70 start at the upper edges of the sidewalls 54, 56, 58, 60 and extend downwardly into the sidewalls 54, 56, 58, 60. Their presence facilitates the movement of the liner necessary to register the posts 40 with the openings 66. The cutouts 70 also provide passageways for some of the liquid collected in the liner whenever the pores of the liner become plugged.

The liner height d is a variable. The height d may substantially equal to the height of the inner space of the basket 20 or may be smaller, as shown in FIG. 6.

When the filter basket 20 is used without a liner 42, it must be periodically removed, emptied and cleaned. When the liner 42 is used, it must be removed and cleaned whenever its pores become clogged.

Figure 10:
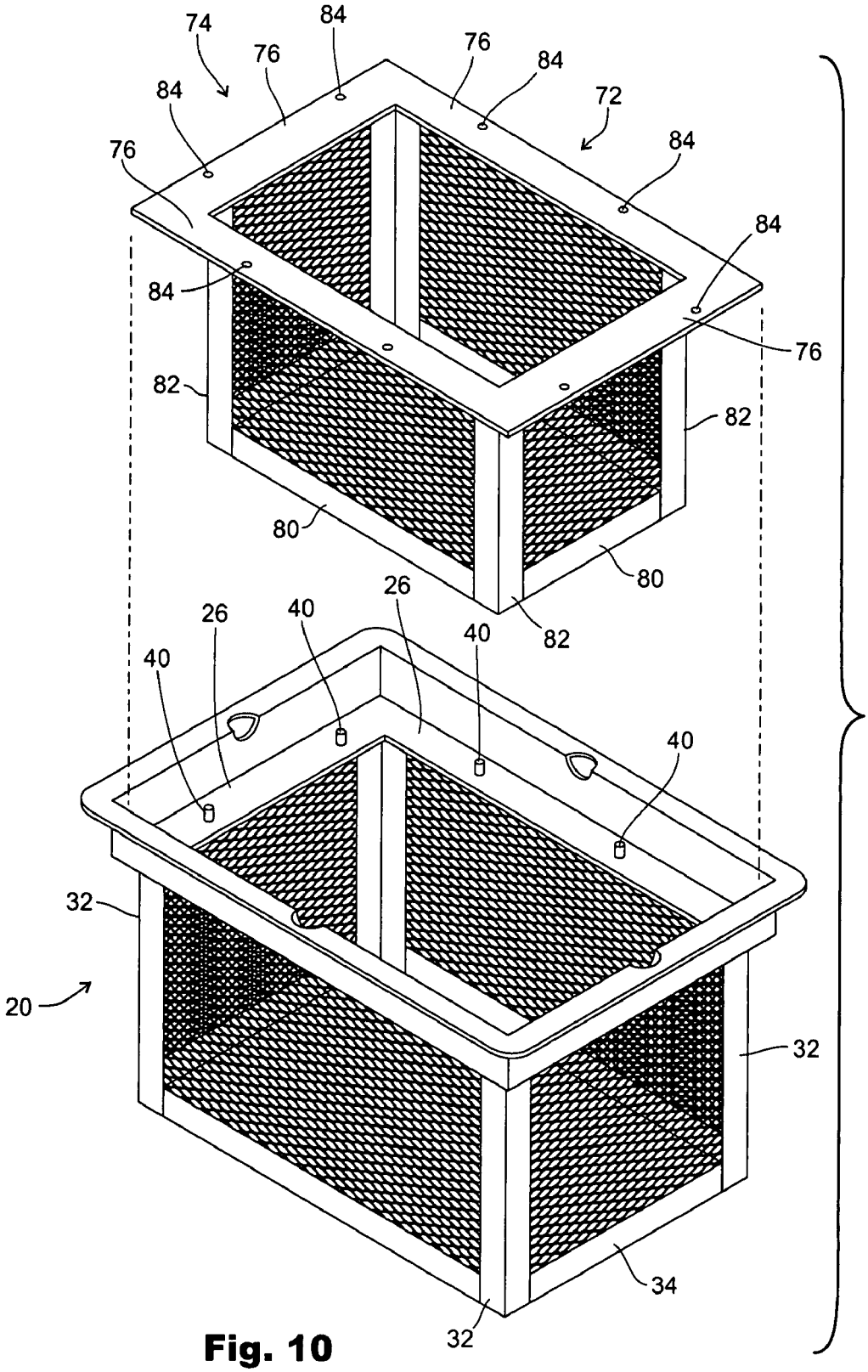
FIG. 10 is an exploded pictorial view of the filter basket shown by FIG. 1 and a second smaller filter basket that is adapted to fit inside the first filter basket of FIG. 1.

The filtration system may include a second filter basket 72 that is sized to fit down into the larger first filter basket 20. This is shown by FIGS. 10 and 14. Basket 72 has an upper rim 74 composed of side members 76 which are connected together where they meet at the corners of the basket 72. Filter basket 72 includes upper and lower horizontal frame members 78, 80 and vertical corner frame members 82. Filter basket 72 also includes sidewalls and a bottom constructed from expanded metal or some other suitable pervious material.

Figure 13:
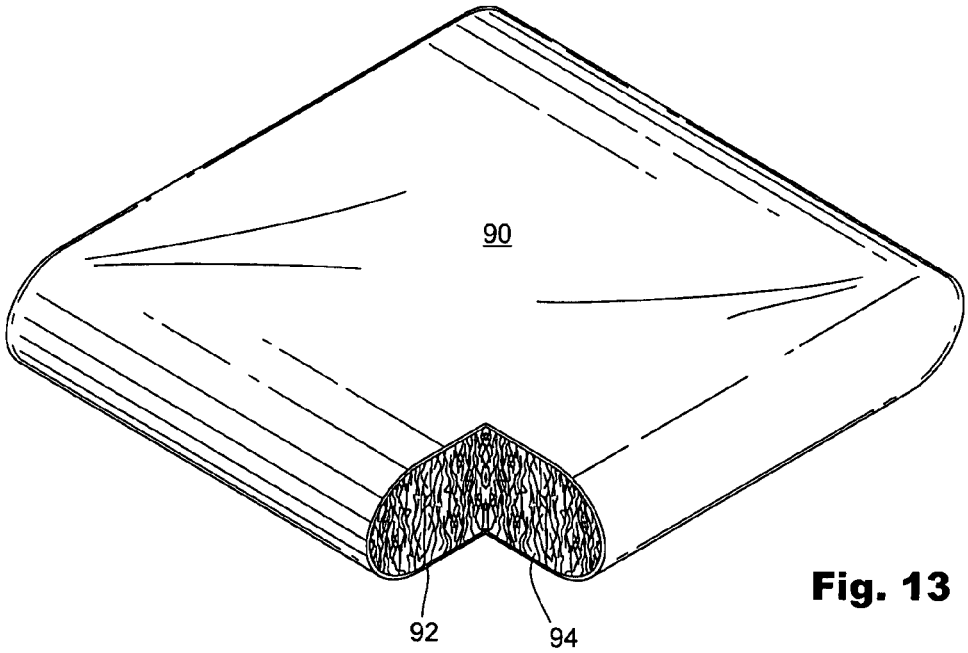
FIG. 13 is a pictorial view of an oil absorbent filter pillow, taken from above and looking down towards the top and two sides where they meet at a corner such view showing the foreground corner portion of the pillow cut away and showing the oil absorbing material that is inside the pillow.

The smaller filter basket 72 is sized to fit down into the larger filter basket 22 with its rim 74 resting on the rim flange 26 and the posts 40 extending through openings in rim 74. The inner basket 72 may be used along with the liner 42 in which case the liner 42 is installed first and then the filter basket 72 is installed (FIG. 11). Or, the absorbent liner 42 may be omitted and an absorbent pillow 90 may be used in its place. As shown by FIG. 13, pillow 90 is similar in construction to a head pillow in that it consists of an outer fabric cover or casing 92 and a filler material 94. As shown by FIG. 14, when the smaller filter basket 72 is inside the larger outer basket 20, a vertical space exists between the bottoms of the two baskets. Preferably, the pillow 90 is adapted to fit in and perhaps fill the vertical space between the bottoms of the two baskets 20, 72. The filler material 94 may be a material which will catch and absorb oils and greases that are in the drain water. When the system shown by FIG. 14 is used, the debris in the drain water will be captured in the inner basket 72. The drain water will pass through the openings in the sidewalls of the two baskets 72, 20 and move to the bottom of the catch basin 10 where drain pipes are connected. Oils and greases in the drain water will be absorbed by the filter pillow 90. When it comes time to clean the system, it is only necessary to remove the grate 16 and pull the inner basket 72 out from inside the outer basket 20. Then, the absorbent pillow 90 can be removed and cleaned or replaced by another filter pillow 90. It may not be necessary to remove the outer basket 20 or, if the sidewalls and/or bottom of the outer basket 20 need to be cleaned, it can be easily removed from the catch basin, cleaned, and then returned. All of these procedures can be quickly and easily performed by a single person.

It is within the scope of the invention to use cylindrical baskets 100, 102 with cylindrical catch basins (not shown). The baskets 100, 102 may include upper rim structures 104, 106, lower rim structures 108, 110 and expanded metal sidewalls 112, 114. The larger basket 100 may include a lower rim flange 116 which includes posts 118. It may also include an upper rim flange 120 which is adapted to sit down onto the grate-supporting shoulder of a cylindrical catch basin. The smaller basket 102 includes an upper rim flange 122 having post-receiving openings 124.

The illustrated embodiments are examples of the present invention and, therefore, are non-limitive. It is to be understood that changes in the particular structure, materials and features of the invention may be made without departing from the spirit and scope of the invention. Therefore, it is my intention that my patent rights not be limited by the particular embodiments that are illustrated and described herein, but rather the invention is to be determined by the following claims, interpreted according to accepted doctrines of patent claim construction.

What is claimed is:

1. A filter system for a catch basin that receives water runoff and includes a top inlet surrounded by a shoulder for receiving and supporting a grate, said filter system comprising:

a nesting filter system comprising a least one filter device; and the at least one filter device comprising at least a larger filter basket (22) comprising horizontal and vertical frame members and pervious side and bottom walls secured to the frame members, an upper rim including an outwardly directed upper rim flange adopted to set down onto the grate supporting shoulder of the catch basin when the larger filter basket (22) is inside the catch basin, an inwardly directed lower rim flange spaced below the upper flange, and a vertical wall extending between the upper and lower rim flanges; and said lower rim flange including vertically upwardly extending posts spaced laterally from the vertical wall.

2. The nesting filter system of claim 1, further comprising;

the at least one filter device further comprising a liner (42) having four sidewalls (54), (56), (58), (60) and a bottom wall (62) is sized to be positioned inside the larger filter basket (22) and having an upper flange portion which includes openings for receiving the posts on the lower rim flange of the larger filter basket (22), said posts extending through said openings.

3. The nesting filter system of claim 2 wherein the liner (42) is made from a fabric material adapted to absorb small particles.

4. The nesting filter system of claim 2, wherein at least one of the sidewalls of the liner (42) includes a cut away portion that extends from an upper edge of the sidewall downwardly into the sidewall.

5. The nesting filter system of claim 4, wherein all four sidewalls of the liner (42) have cutouts extending from upper edges of the walls downwardly into the walls.

6. The nesting filter system of claim 5, wherein the upper flange portion of the liner (42) includes four side parts and two openings in each side part, and the lower rim flange of the filter basket includes a post for each said opening.

7. The nesting filter system of claim 6, wherein the openings in the upper flange portion of the liner (42) are structurally reinforced by a ring member that surrounds the opening.

8. The nesting filter system of claim 2, further comprising;

a second filter basket (72) that sits down into the liner (42); and the second filter basket (72) has side and bottom walls spaced inwardly and upwardly from the side and bottom walls of the liner (42); said second filter basket (72) having a flange at its upper end that includes openings into which the mounting posts are received when the second filter basket (72) is seated down into the liner (42).

9. The nesting filter system of claim 1 further comprising;

a second filter basket (72) that sits down into the at least a larger filter basket (22) and has side and bottom walls spaced inwardly and upwardly from the side and bottom walls of the at least a larger filter basket (22), said second filter basket (72) having a flange at its upper end that includes openings into which the mounting posts are received when the second filter basket (72) is in the at least a larger filter basket (22), whereby when the second basket (72) is inside the at least a larger basket (22) spaces exist horizontally between the sidewalls of the at least a larger filter basket (22) and the second filter basket (72) and vertically between the bottoms of the at least a larger filter basket (22) and the second filter basket (72).

10. The nesting filter system of claim 9, further comprising an absorbent filter pillow positioned inside the at least a larger filter basket (22) between the bottom of the at least a larger filter basket (22) and the bottom of the second filter basket (72).

11. The nesting filter system of claim 10, wherein the absorbent filter pillow includes a pervious casing and an oil absorbing filler material inside the casing.

12. The nesting filter system of claim 1, wherein the at least a larger filter basket (22) has expanded metal side and bottom walls.

13. The nesting filter system of claim 1, wherein the at least a larger filter basket (22) has four quadrate sides and each side and the bottom is a quadrate.

14. The nesting filter system of claim 13, wherein the at least a larger filter basket (22) has expanded metal side and bottom walls.

15. The nesting filter system of claim 1, wherein the at least a larger filter basket (22) has a cylindrical sidewall and a circular bottom wall, and the top flange is a circular ring.

16. The nesting filter system of claim 15, wherein the at least a larger filter basket (22) has expanded metal side and bottom walls.

17. A nesting filter system for a catch basin that receives water runoff and includes a top inlet surrounded by a shoulder for receiving and supporting a grate, said filter system comprising:

at least a larger filter basket (22) comprising horizontal and vertical frame members and pervious side and bottom walls secured to the frame members, an upper rim including an outwardly directed upper rim flange adopted to set down onto the grate supporting shoulder of the catch basin when the first filter basket is inside the catch basin, an inwardly directed lower rim flange spaced below the upper flange, and a vertical wall extending between the upper and lower rim flanges;

a second filter basket (72) that sits down into the at least a larger filter basket (22) and has side and bottom walls spaced inwardly and upwardly from the side and bottom walls of the at least a larger filter basket (22), said second filter basket (72) having a flange at its upper end that sits down on the lower rim flange of the at least a larger filter basket (22) when the second filter basket (72) is in the at least a larger filter basket (22); and whereby when the second basket (72) is inside the at least a larger filter basket (22) spaces exist horizontally between the sidewalls of the first and second baskets and vertically between the bottoms of the first and second baskets.

18. The nesting filter system of claim 17, further comprising an absorbent filter pillow positioned inside the first filter basket between the bottom of the first filter basket and the bottom of the second filter basket.

19. The nesting filter system of claim 18, wherein the absorbent filter pillow includes a pervious casing and an oil absorbing filter material inside the casing.

20. The nesting filter system of claim 17, wherein each filter basket has four quadrate sides and each side and the bottom is a quadrate.

21. The nesting filter system of claim 17, wherein each filter basket has a cylindrical sidewall and a circular bottom wall, and the top flange is a circular ring.

* * * * *